US009330674B2

(12) United States Patent
Park et al.

(10) Patent No.: US 9,330,674 B2
(45) Date of Patent: May 3, 2016

(54) SYSTEM AND METHOD FOR IMPROVING SOUND QUALITY OF VOICE SIGNAL IN VOICE COMMUNICATION

(75) Inventors: Seong-Soo Park, Seoul (KR); Seong Il Jeong, Ansan-si (KR); Dong Gyung Ha, Seoul (KR); Jae Hoon Song, Seoul (KR)

(73) Assignee: SK TELECOM. CO., LTD., Seoul (KR)

( * ) Notice: Subject to any disclaimer, the term of this patent is extended or adjusted under 35 U.S.C. 154(b) by 392 days.

(21) Appl. No.: 13/880,096

(22) PCT Filed: Oct. 18, 2011 (Under 37 CFR 1.47)

(86) PCT No.: PCT/KR2011/007763
§ 371 (c)(1), (2), (4) Date: Nov. 20, 2013

(87) PCT Pub. No.: WO2012/053810
PCT Pub. Date: Apr. 26, 2012

(65) Prior Publication Data
US 2015/0310873 A1 Oct. 29, 2015

(30) Foreign Application Priority Data
Oct. 18, 2010 (KR) ..... 10-2010-0101528

(51) Int. Cl.
*G10L 21/02* (2013.01)
*G10L 21/0232* (2013.01)

(52) U.S. Cl.
CPC ..... *G10L 21/02* (2013.01); *G10L 21/0232* (2013.01)

(58) Field of Classification Search
CPC ..... G10L 21/0208; G10L 21/02; G10L 2021/02166; H04M 9/082; H04R 3/005
USPC ..... 704/205, 226, 219, 233, 234, 253; 381/56, 104, 108, 57, 58, 92, 94.3, 381/94.7
See application file for complete search history.

(56) References Cited

U.S. PATENT DOCUMENTS 7,797,154 B2 * 9/2010 Ichikawa ..... 704/226

FOREIGN PATENT DOCUMENTS

| | | |
|---|---|---|
| JP | 2006003899 | 1/2006 |
| JP | 2010102199 | 5/2010 |
| KR | 1020090104559 | 10/2009 |
| WO | 2005064595 | 7/2005 |

OTHER PUBLICATIONS

Korean Office Action for application No. 10-2010-0101528 dated Aug. 8, 2012.
Korean Search Report mailed on May 29, 2012 for PCT/KR2011/007763.
International Search Report mailed May 29, 2012 for PCT/KR2011/007763.

* cited by examiner

*Primary Examiner* — Charlotte M Baker
(74) *Attorney, Agent, or Firm* — Hauptman Ham, LLP

(57) ABSTRACT

Disclosed are a voice communication system and a voice communication method which set a subtraction weight for each of a plurality of frequency subbands split based on a particular frequency response characteristic set to the system, calculate a gain function for each frequency subband according to the particular frequency response characteristic based on the subtraction weight for each of the frequency subbands, and improve sound quality of a voice signal by reflecting the calculated gain function.

18 Claims, 4 Drawing Sheets

SYSTEM AND METHOD FOR IMPROVING SOUND QUALITY OF VOICE SIGNAL IN VOICE COMMUNICATION

CROSS-REFERENCE TO RELATED APPLICATION

The present application is a continuation of International Application No. PCT/KR2011/007763 filed on Oct. 18, 2011, which is based on, and claims priority from, KR Application Serial Number 10-2010-0101528, filed on Oct. 18, 2010. The disclosures of the above-listed applications are hereby incorporated by reference herein in their entirety.

FIELD

The disclosure relates to improving sound quality of a voice signal in a voice communication.

BACKGROUND

The statements in this section merely provide background information related to the present disclosure and may not constitute prior art.

In real life, background noise contaminates pure voice and degrades the performance and capabilities of voice communication systems such as mobile phones, voice recognition, voice coding, speaker recognition and the like. Accordingly, research on sound quality improvement to reduce noise effects and enhance system capabilities has progressed over time, and the importance thereof currently receives a lot of attention.

Meanwhile, a Spectral Subtraction (SS) is a typical method widely used in a single channel due to its low cost and easy implementation among various sound quality improving methods. The inventors have noted that in the spectral subtraction there might remain musical noise corresponding to a new artifact sound in the voice signals after the spectral subtraction.

The musical noise refers to a random frequency component generated by evaluating estimated noise as being lower than original noise, and furthermore refers to a tone which perceivedly annoys a listener since residue of the musical noise on time and frequency axes in a spectrogram is discontinuously spread.

In this connection, in order to suppress the residue of the musical noise, the spectral subtraction method based on a gain function has been proposed. The inventors have noted that most of the proposed methods might not be able to efficiently improve sound quality in a noise environment of a low Signal to Noise Ratio (SNR). It is probably because the improved voice still has musical noise and/or low speech intelligibility.

Accordingly, success and failure of the sound quality improvement using a gain function based-Spectral Subtraction (SS) may be determined according to an accurate gain function setting by which a small loss of voice signal is generated and the residue of musical noise is suppressed.

Meanwhile, in a voice communication system, a sending frequency response (SFR) filter has a function to enhance or weaken a response of a particular frequency band in order to reproduce corresponding voice as much as possible by providing a flat frequency response pattern for the provided voice signal. The inventors have noted that when the voice improved through the gain function based-spectral subtraction (SS) method is filtered by the SFR filter function, in an enhanced band, not only the voice but also the noise are enhanced and thus large noise might be heard by a listener, and, inversely, in a weak band, not only the noise but also the voice is weakened and thus the listener might experience low speech intelligibility.

SUMMARY

In accordance with some embodiments, the system for improving sound quality of a voice signal in voice communication comprise a sound quality improving apparatus configured to set a subtraction weight for each of a plurality of frequency subbands split based on a particular frequency response characteristic set to the system, to calculate a gain function for each frequency subband according to the particular frequency response characteristic based on the subtraction weight for each of the frequency subbands, and to improve sound quality of a voice signal by reflecting the calculated gain function. The system further comprise a frequency response filter apparatus configured to filter the voice signal provided from the sound quality improving apparatus according to the preset frequency response characteristic and configured to output the filtered voice signal.

In accordance with some embodiments, the system performs a method for improving sound quality of a voice signal in voice communication. The system is configured to receive a voice signal, to split a frequency band into a plurality of frequency subbands according to a particular frequency response characteristic, to set a subtraction weight for each of the plurality of split frequency subbands, and to calculate a gain function for each of the frequency subbands based on the set subtraction weight for each of the frequency subbands.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION

The disclosure provides a modified spectral subtraction (SS) method based on the gain function having weights differentially set according to a sending frequency response characteristic which enhances or weakens a response of a particular frequency band in a voice communication system. The at least one embodiment of this disclosure provides a method and a system to suppress the residual musical noise in the enhanced band which may be caused by the SFR characteristic and guarantee speech intelligibility in the weak band by improving the sound quality of the voice signal through the modified spectral subtraction method based on gain functions differentially set considering the sending frequency response characteristic.

Hereinafter, at least one embodiment of the present disclosure will be described with reference to the accompanying drawings.

Figure 1:
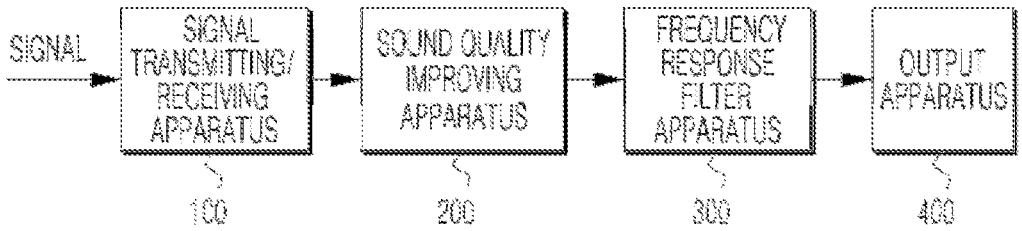
FIG. 1 is a schematic block diagram of a voice communication system according to at least one embodiment.

FIG. 1 illustrates a schematic block diagram of a voice communication system according to at least one embodiment.

As illustrated in FIG. 1, the voice communication system according to at least one embodiment comprises a sound quality improving apparatus 200 configured to set a subtraction weight for each of a plurality of frequency subbands divided based on a particular frequency response characteristic set to the system, to calculate a gain function for each frequency band according to the particular frequency response characteristic based on the subtraction weight for each frequency subband, and to improve sound quality of a voice signal provided from the outside by reflecting the calculated gain function and a frequency response filter apparatus 300 configured to filter the voice signal provided from the sound quality improving apparatus 200 in accordance with the preset frequency response characteristic and to output the filtered voice signal.

According to a Sending Frequency Response (SFR) by an SFR filter function generally used in the voice communication system, it can be identified that a response of a particular frequency band is enhanced or another particular frequency band is weakened according to a sending frequency response characteristic. Specifically, it may be identified that, compared to another frequency band, the response is relatively further enhanced in a frequency band ranging from 0.6 kHz to 3.5 kHz.

The voice communication system according to at least one embodiment as illustrated in FIG. 1 also adopts the frequency response filter apparatus 300 having the corresponding frequency response characteristic.

Hereinafter, in detailed descriptions of the voice communication system according to an embodiment of the present disclosure, the sound quality improving apparatus 200 detects a particular frequency response characteristic set to the system, that is, a Sending Frequency Response (SFR) characteristic set to the frequency response filter apparatus 300, and sets a subtraction weight for each of a plurality of frequency subbands divided based on the detected SFR characteristic. Further, the sound quality improving apparatus 200 calculates a gain function for each frequency band according to the particular frequency response characteristic based on the subtraction weight for each frequency subband.

The sound quality improving apparatus 200 receives a voice signal provided from a signal transmitting/receiving apparatus 100 for receiving a signal from the outside.

In addition, as described above, the sound quality improving apparatus 200 improves sound quality for the voice signal provided from the outside, that is, the signal transmitting/receiving apparatus 100 by reflecting the gain function for each frequency band calculated according to the sending frequency response characteristic of the system. The signal transmitting/receiving 100 includes one or more network interfaces, which can communicate to each other and various networks including, but not limited to, cellular, Wi-Fi, LAN, WAN, CDMA, WCDMA, GSM, LTE and EPC networks, and cloud computing networks. The signal transmitting/receiving 100 is implemented by one or more processors and/or application-specific integrated circuits (ASICs).

Then, the sound quality improving apparatus 200 may improve sound quality for the voice signal through a modified spectral subtraction method based on the gain function having weights differentially set according to the sending frequency response characteristic and provide the improved voice signal to the frequency response filter apparatus 300.

The frequency response filter apparatus 300 filters the voice signal provided from the sound quality improving apparatus 200 in accordance with the preset frequency response characteristic and outputs the filtered voice signal to an output apparatus 400.

Here, it is preferable that the frequency response filter apparatus 300 has the sending frequency response (SFR) characteristic which enhances or weakens a response of a particular frequency band in order to reproduce corresponding voice through the output apparatus 400 as accurately as possible by providing a flat frequency response pattern to the provided voice signal. The sending frequency response characteristic set to the frequency response filter apparatus 300 may be information selectively changed/set by a system user or information fixedly set without the change.

Accordingly, the frequency response filter apparatus 300 performing the filtering, of enhancing or weakening the response of the particular frequency band, of the voice signal provided from the sound quality improving apparatus 200 in accordance with the set sending frequency response characteristic and outputs the voice signal to the output apparatus 400. Therefore, the SFR response output from the frequency response filter apparatus 300 is either enhanced or weakened at the particular frequency band according to the sending frequency response characteristic. Here, the output apparatus 400 may include a speaker. All the components of the voice communication system, such as the sound quality improving apparatus 200, the frequency response filter apparatus 300, and the voice signal to the output apparatus 400 are implemented by one or more processors and/or application-specific integrated circuits (ASICs)

Figure 2:
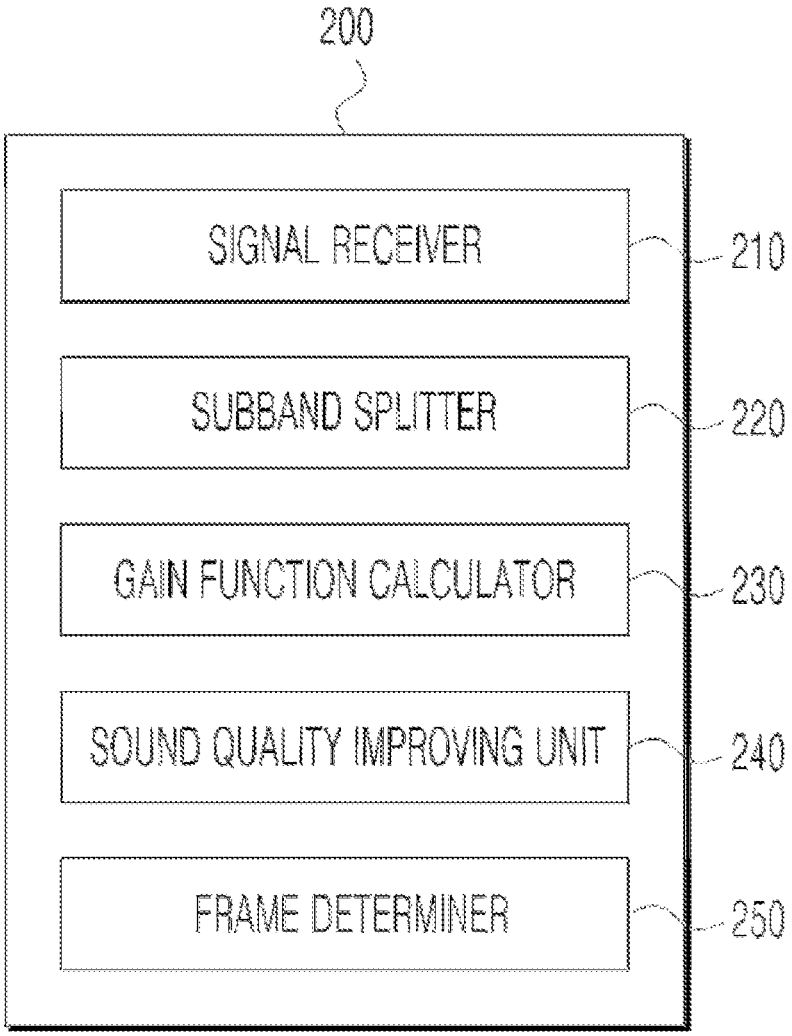
FIG. 2 is a block diagram of a sound quality improving apparatus according to at least one embodiment.

Hereinafter, a detailed configuration of the sound quality improving apparatus 200 according to at least one embodiment will be described with reference to FIG. 2.

The sound quality improving apparatus 200 according to at least one embodiment comprises a signal receiver 210 configured to receive a voice signal provided from the outside, a subband splitter 220 configured to split a frequency band into a plurality of frequency subbands in accordance with a particular frequency response characteristic set to the system, a gain function calculator 230 configured to set a subtraction weight for each of the plurality of split frequency subbands and configured to calculate a gain function for each frequency band according to the particular frequency response characteristic based on the subtraction weight for each frequency subband, and a sound quality improving unit 240 configured to improve sound quality of the voice signal by reflecting the calculated gain function.

Further, the sound quality improving apparatus 200 according to an embodiment of the present disclosure may further comprise a frame determiner 250 configured to determine whether a current frame of the voice signal is a Speech-like Frame (SF) or a Noise-like Frame (NF) based on sound quality improvement degree information on a previous frame of the voice signal performed by the sound quality improving unit 240.

The signal receiver 210 receives the voice signal provided from the outside, that is, the signal transmitting/receiving apparatus 100.

The subband splitter 220 splits the frequency band into a plurality of frequency subbands in accordance with the particular frequency response characteristic set to the system.

In other words, the subband splitter 220 may detect the particular frequency response characteristic set to the system, that is, the sending frequency response characteristic set to the frequency response filter apparatus 300 included in the system, and split an entire frequency band into a plurality of frequency subbands in accordance with the detected sending frequency response characteristic.

The gain function calculator 230 sets the subtraction weight for each of the plurality of frequency subbands split by the subband splitter 220 and calculates the gain function for each frequency band according to the particular frequency response characteristic based on the subtraction weight for each set frequency subband.

More specifically, the gain function calculator 230 sets subtraction weights different according to the plurality of frequency subbands split by the subband splitter 220 through a predefined weight setting policy.

For example, when the current frame of the voice signal which is received at this time is the speech-like frame based on a result of the determination by the frame determiner 250, the gain function calculator 230 may set the subtraction weight $k_{SF}$ corresponding to the speech-like frame for each frequency subband through the weight setting policy in setting the subtraction weight different according to each of the plurality of frequency subbands split by the subband splitter 220.

Further, when the current frame of the voice signal which is received at this time is the noise-like frame based on a result of the determination by the frame determiner 250, the gain function calculator 230 may set the subtraction weight $k_{NF}$ corresponding to the noise-like frame for each frequency subband through the weight setting policy in setting the subtraction weight different according to each of the plurality of frequency subbands split by the subband splitter 220.

Here, the subtraction weight corresponds to the weight set to determine noise subtraction information in a speech-like subband or noise-like subband.

Further, the gain function calculator 230 calculates the gain function for each frequency band according to the particular frequency response characteristic based on the set subtraction weight for each frequency subband.

More specifically, the gain function calculator 230 determines whether a noise quantity of the voice signal corresponding to each node exceeds a preset noise threshold in the current frame of the voice signal based on a plurality of nodes split from the frequency band according to a preset node split policy, and selects and allocates the corresponding subtraction weight among the subtraction weights set for respective frequency subbands in accordance with the corresponding node which is determined to exceed the noise threshold.

That is, the gain function calculator 230 splits the entire frequency band into a plurality of nodes according to the preset node split policy.

Further, the case where the current frame of the voice signal is the speech-like frame will be described. When it is determined that the current frame of the voice signal is the speech-like frame, the gain function calculator 230 recognizes a noise threshold $SF_{TH}$ corresponding to a preset speech-like frame and determines whether a noise quantity $U_{m8nr,i}(j)$ of the voice signal corresponding to each node exceeds the noise threshold $SF_{TH}$ corresponding to the speech-like frame in the current frame of the voice signal according to the noise threshold $SF_{TH}$ based on the plurality of split nodes.

Here, i denotes a frame index of the voice signal, and j denotes an index of a node $2^{P-p}$ among $2^p$ nodes split from an entire frequency band bin $2^P$, that is, a node index. Here, P denotes an index for determining an FFT point, and p denotes an index for determining the number of nodes.

The gain function calculator 230 may select and allocate the corresponding subtraction $k_{SF}$ among the subtraction weights set for respective frequency subbands in accordance with the corresponding node which is determined to exceed the noise threshold as a result of the determination of whether or not the noise quantity of the voice signal exceeds the noise threshold.

For example, when the corresponding node is included in a first frequency subband area (for example, $j<SFR_{SB}(0)$) in accordance with the corresponding node which is determined to exceed the noise threshold $SF_{TH}$, the gain function calculator 230 can allocate the subtraction weight corresponding to the first frequency subband in accordance with the voice signal of the corresponding node.

Here, $SFR_{SB}(I)$ denotes the number of nodes of the frequency subband according to the sending frequency response (SFR) characteristic, SB denotes a size of the frequency subband, and I is a spectrum position index existing within the frequency subband split from the entire nodes $2^{P-p}$ according to the sending frequency response (SFR) characteristic provided by the system.

When the corresponding node is included in the first frequency subband area (for example, $j<SFR_{SB}(0)$), the gain function calculator 230 can allocate the subtraction weight $k_{SF}(0)$ corresponding to the first frequency subband, that is, frequency subband(I(0)) in accordance with the voice signal of the corresponding node. Here, the case where the subtraction weight $k_{SF}(0)$ is allocated is determined to correspond to a weak band according to the sending frequency response characteristic, so that it may be analyzed to assign the relatively lower noise weight.

Further, when the corresponding node is not included in the first frequency subband area but is included in a second frequency subband area (for example, $j<SFR_{SB}(1)$) in accordance with the corresponding node which is determined to exceed the noise threshold $SF_{TH}$=, the gain function calculator 230 can allocate the subtraction weight $k_{SF}(I)$ corresponding to the corresponding frequency subband(I) included in accordance with the voice signal of the corresponding node.

In addition, when the corresponding node is not included in both the first and second frequency subband areas (for example, $j\geq SFR_{SB}(1)$) in accordance with the corresponding node which is determined to exceed the noise threshold $SF_{TH}$, the gain function calculator 230 can allocate a particular maximum subtraction weight $k_{SF}(L)$ in accordance with the voice signal of the corresponding node. Here, the case where the subtraction weight $k_{SF}(L)$ is allocated is determined to correspond to an enhanced band according to the sending frequency response characteristic, so that it may be analyzed to assign the relatively higher noise weight.

As described above, after selecting and allocating the corresponding subtraction weight among subtraction weights set for respective frequency subbands in accordance with the corresponding node which is determined to exceed the noise threshold, the gain function calculator 230 can calculate the gain function based on at least one of the subtraction weights allocated in accordance with the voice signal of the corresponding node and the noise quantity of the voice signal of the corresponding node.

That is, the gain function calculator 230 may calculate the following gain function.

$$G_i^{SFR}(k)=1-(1+k_{SF})U_{m8nr,i}(j)$$

Meanwhile, as a result of determination whether the noise quantity $U_{m8nr,i}(j)$ of the voice signal corresponding to each node exceeds the noise threshold $SF_{TH}$ corresponding to the speech-like frame in the current frame of the voice signal, based on the noise threshold $SF_{TH}$ gain function calculator 230 can calculate the gain function of the voice signal of the corresponding node in accordance with the voice signal of the corresponding node of which noise quantity is determined to be equal to or smaller than the noise threshold $SF_{TH}$.

That is, the gain function calculator 230 may calculate the following gain function in accordance with the voice signal of the corresponding node of which noise quantity $U_{m8nr,i}(j)$ the voice signal is determined to be equal to or smaller than the noise threshold $SF_{TH}$.

$$G_i^{SFR}(k)=1-U_{m8nr,i}(j)$$

Meanwhile, the case where the current frame of the voice signal is a noise-like frame will be described. When it is determined that the current frame of the voice signal is a noise-like frame, the gain function calculator 230 recognizes the noise threshold $NF_{TH}$ corresponding to a preset noise-like frame and determines whether the noise quantity $U_{m8nr,i}(j)$ of the voice signal corresponding to each node exceeds the noise threshold $NF_{TH}$ corresponding to the noise-like frame in the current frame of the voice signal according to the noise threshold $NF_{TH}$ based on the plurality of split nodes.

Accordingly, the gain function calculator 230 can select and allocate the corresponding subtraction weight $k_{NF}$ among the subtraction weights set for respective frequency subbands in accordance with the corresponding node which is determined to exceed the noise threshold as a result of the determination whether to exceed the noise threshold.

For example, when the corresponding node is included in the first frequency subband area (for example, $j<SFR_{SB}(0)$) in accordance with the corresponding node which is determined to exceed the noise threshold $NF_{TH}$, the gain function calculator 230 can allocate the subtraction weight corresponding to the first frequency subband in accordance with the voice signal of the corresponding node.

Accordingly, when the corresponding node is included in the first frequency subband area (for example, $j<SFR_{SB}(0)$), the gain function calculator 230 can allocate the subtraction weight $k_{NF}(0)$ corresponding to the first frequency subband, that is, frequency subband(I(0)) in accordance with the voice signal of the corresponding node. Here, the case in which the subtraction weight $k_{NF}(0)$ is allocated is determined to correspond to a weak band according to the sending frequency response characteristic, so that it may be analyzed to assign the relatively lower noise weight.

Further, when the corresponding node is not included in the first frequency subband area but is included in a second frequency subband area (for example, $j<SFR_{SB}(1)$) in accordance with the corresponding node which is determined to exceed the noise threshold $NF_{TH}$, the gain function calculator 230 can allocate the subtraction weight $k_{NF}(I)$ corresponding to the corresponding frequency subband(I) in accordance with the voice signal of the corresponding node.

In addition, when the corresponding node is not included in both the first and second frequency subband areas (for example, $j\geq SFR_{SB}(1)$) in accordance with the corresponding node which is determined to exceed the noise threshold $NF_{TH}$, the gain function calculator 230 can allocate a particular maximum subtraction weight $k_{NF}(L)$ in accordance with the voice signal of the corresponding node. Here, the case in which the subtraction weight $k_{NF}(L)$ is allocated is determined to correspond to an enhanced band according to the sending frequency response characteristic, so that it may be analyzed to assign the relatively higher noise weight.

As described above, after selecting and allocating the corresponding subtraction weight among subtraction weights set for respective frequency subbands in accordance with the corresponding node which is determined to exceed the noise threshold, the gain function calculator 230 can calculate the gain function based on at least one of the subtraction weight allocated in accordance with the voice signal of the corresponding node and the noise quantity of the voice signal of the corresponding node.

That is, the gain function calculator 230 may calculate the following gain function.

$$G_i^{SFR}(k)=1-(1+k_{SF})U_{m8nr,i}(j)$$

Meanwhile, as a result of determination whether the noise quantity $U_{m8nr,i}(j)$ of the voice signal corresponding to each node exceeds the noise threshold $NF_{TH}$ corresponding to the noise-like frame in the current frame of the voice signal based on the noise threshold $NF_{TH}$, the gain function calculator 230 can calculate the gain function of the voice signal of the corresponding node in accordance with the voice signal of the corresponding node of which noise quantity is determined to be equal to or smaller than the noise threshold $NF_{TH}$.

That is, the gain function calculator 230 may calculate the following gain function in accordance with the voice signal of the corresponding node of which noise quantity $U_{m8nr,i}(j)$ is determined to be equal to or smaller than the noise threshold $NF_{TH}$.

$$G_i^{SFR}(k)=1-U_{m8nr,i}(j)$$

The sound quality improving unit 240 improves sound quality of the voice signal by reflecting the gain function calculated by the gain function calculator 230.

Specifically, the sound quality improving unit 240 improves sound quality of the voice signal of which the corresponding gain function exceeds a smoothing coefficient β with reflection of the corresponding gain function based on the gain function for each frequency band according to the particular frequency response characteristic calculated by the gain function calculator 230 and improves sound quality of the voice signal of which the corresponding gain function does not exceed the smoothing coefficient β with reflection of the spectral smoothing coefficient β.

In other words, the sound quality improving unit 240 can improve the sound quality of the voice signal by reflecting the gain function calculated by the gain function calculator 230 through equation (1) below.

$$\hat{S}_i(k)=\begin{cases} G_i^{SFR}(k)Y_i(k), & \text{if } G_i^{SFR}(k)>\beta \\ \beta Y_i(k), & \text{otherwise} \end{cases} \quad (1)$$

Further, it is preferable that the sound quality improving unit 240 stores/manages sound quality improvement performance degree information according to the sound quality improvement performed for the current frame of the voice signal and the frame determiner 250 refers to the stored/managed sound quality improvement performance degree information in the future.

The sound quality improving apparatus 200 allocates a relatively high noise weight to the enhanced band and a relatively low noise weight to the weak band by considering the sending frequency response characteristic of the frequency response filter apparatus 300, so that the sound quality of the voice signal can be improved through a modified spectral subtraction method based on the gain function reflecting the allocation.

Further, the sound quality improving unit 240 provides the voice signal according to the sound quality improvement performance, that is, improved voice signal to the frequency response filter apparatus 300.

As described above, the frequency response filter apparatus 300 filters the voice signal, that is, the provided voice signal provided from the sound quality improving apparatus 200 according to the preset frequency response characteristic and outputs the filtered voice signal to the output apparatus 400.

As described above, the voice communication system according to an embodiment of the present disclosure can suppress the residual musical noise in the enhanced band which may be caused by the SFR characteristic and guarantee speech intelligibility in the weak band by improving the sound quality of the voice signal through the modified spectral subtraction method based on gain functions differentially set considering the sending frequency response characteristic.

Figure 3:
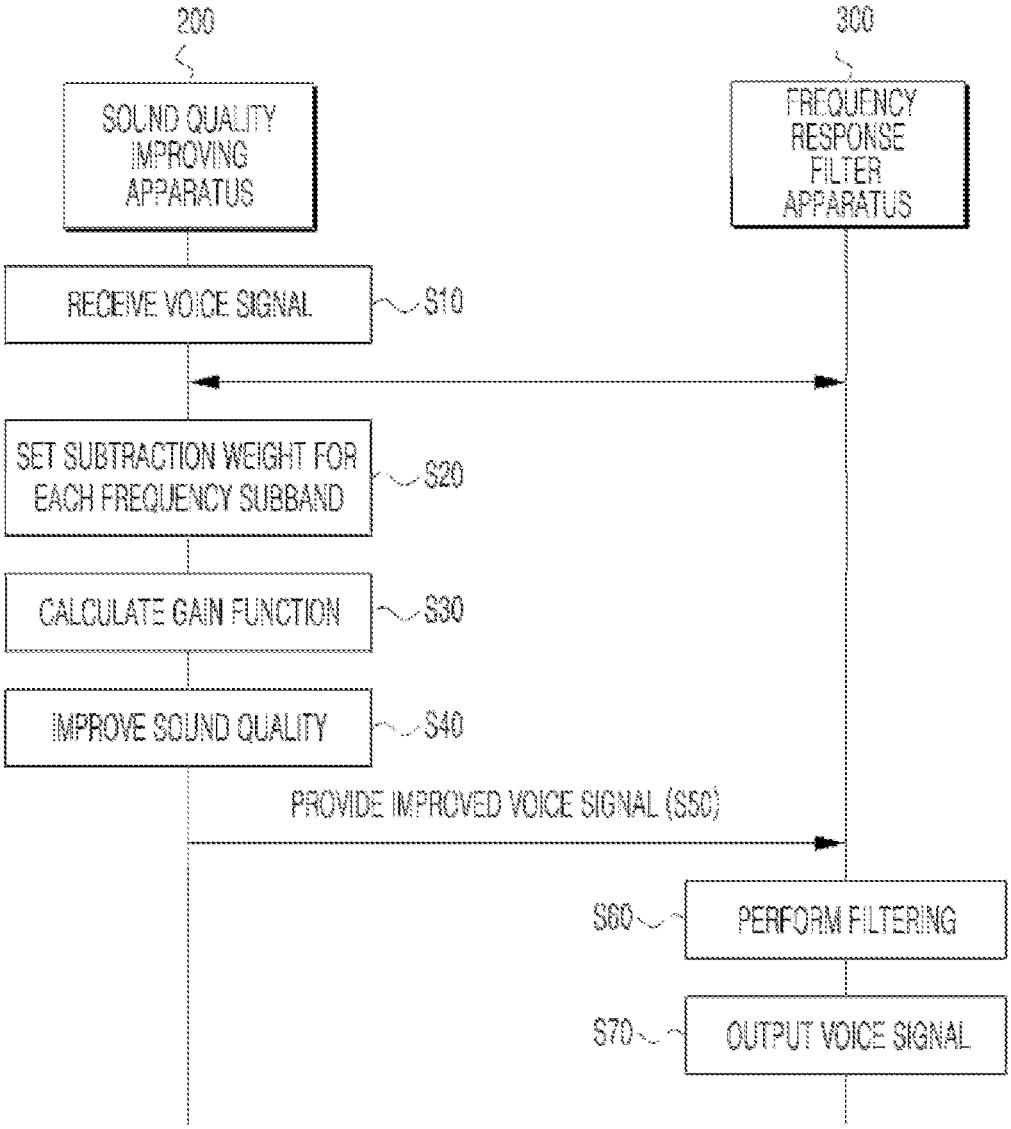
FIG. 3 is a flowchart of operation of the sound quality improving apparatus according to at least one embodiment.
Figure 4:
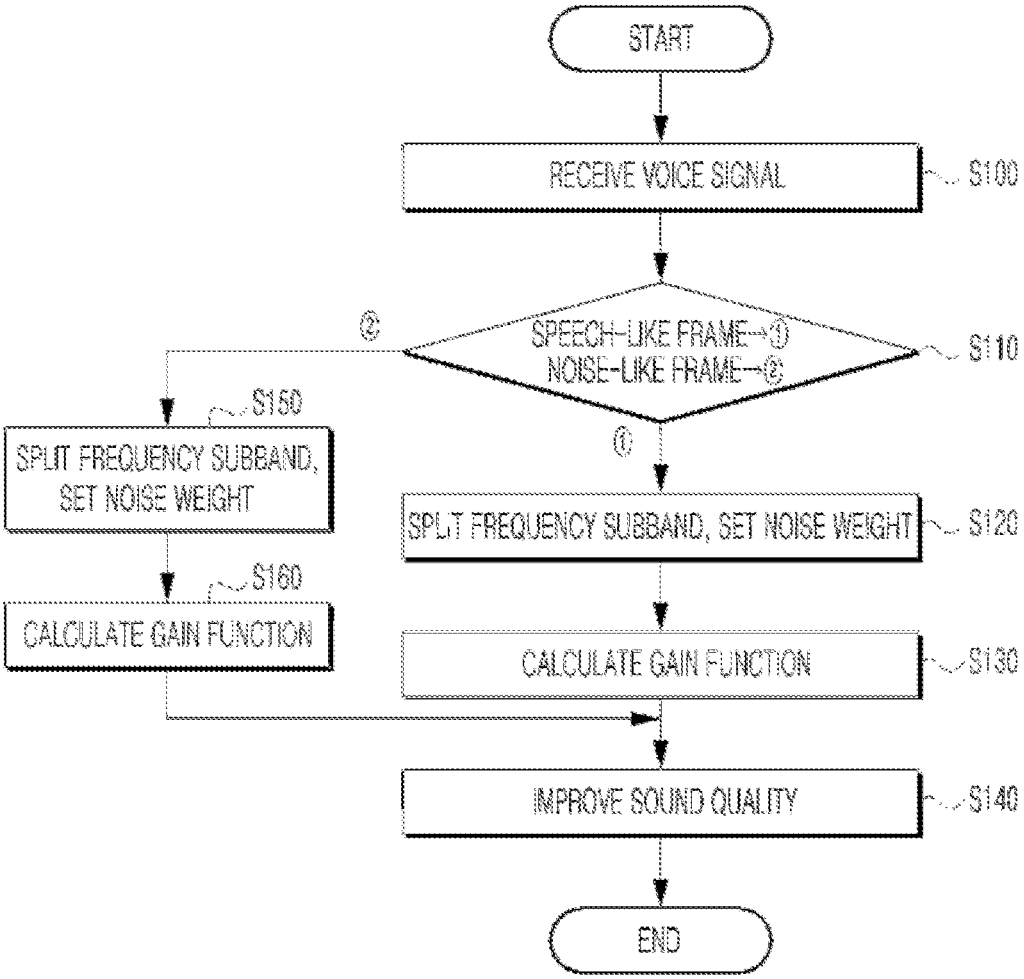
FIG. 4 is a flowchart of a sound quality improving method in a voice communication according to at least one embodiment.

Hereinafter, a voice communication method according to an exemplary embodiment of the present disclosure will be described with reference to FIGS. 3 and 4. Here, reference numerals of the configurations illustrated in FIGS. 1 and 2 will be referred to describe the configurations of FIGS. 3 and 4 for convenience of the description. Other components of the sound quality improving apparatus 200, such as the signal receiver 210, the subband splitter 220, the gain function calculator 230, the sound quality improving unit 240, the voice signal and the frame determiner 250, are implemented by one or more processors and/or application-specific integrated circuits (ASICs)

The voice communication method according to the exemplary embodiment of the present disclosure will be described with reference to FIG. 3 first.

The sound quality improving apparatus 200 receives the voice signal from the outside in step S10. That is, the sound quality improving apparatus 200 can receive the voice signal provided from the signal transmitting/receiving apparatus 100 receiving the signal from the outside.

The sound quality improving apparatus 200 improves sound quality of the voice signal provided from the outside, that is, the signal transmitting/receiving apparatus 100, by reflecting the gain function for each frequency band calculated according to the sending frequency response characteristic of the system.

That is, the sound quality improving apparatus 200 sets the subtraction weight for each of a plurality of split frequency subbands based on a particular frequency response characteristic set by the system in step S20.

For example, the sound quality improving apparatus 200 detects the sending frequency response (SFR) characteristic set to the frequency response filter apparatus 300 and sets the subtraction weight for each of the plurality of split frequency subbands based on the detected sending frequency response characteristic.

Further, the sound quality improving apparatus 200 calculates the gain function for each frequency band according to the particular frequency response characteristic based on the subtraction weight for each frequency subband in step S30.

The sound quality improving apparatus 200 improves the sound quality of the voice signal by reflecting the gain function calculated in step S30 in step S40. That is, the sound quality improving apparatus 200 improves the sound quality of the voice signal through the modified spectral subtraction method based on the gain functions having weights set differentially considering the sending frequency response characteristic and provides the improved voice signal to the frequency response filter apparatus 300 in step S50.

The frequency response filter apparatus 300 filters the voice signal provided from the sound quality improving apparatus 200 according to the preset frequency response characteristic in step S60, and outputs the filtered voice signal to the output apparatus 400 in step S70.

Here, in order to provide a flat frequency response pattern of the provided voice signal and reproduce the corresponding voice through the output apparatus 400 as accurately as possible, it is preferable that the frequency response filter apparatus 300 has the sending frequency response (SFR) characteristic to enhance or weaken the response of the particular frequency band. Here, the sending frequency response characteristic set to the frequency response filter apparatus 300 may be information selectively changed/set by a system user or information fixedly set without any change.

The frequency response filter apparatus 300 outputs the voice signal provided from the sound quality improving apparatus 200 to the output apparatus 400 by performing filtering of enhancing a particular frequency band and weakening another particular frequency band according to the set sending frequency response characteristic. Accordingly, the SFR response from the frequency response filter apparatus 300 will be enhanced in a particular frequency band and will be weakened in another particular frequency band according to the sending frequency response characteristic. Here, the output apparatus 400 may include a speaker.

Hereinafter, an operation method of the sound quality improving apparatus according to an exemplary embodiment of the present disclosure will be described with reference to FIG. 4.

In the operation method of the sound quality improving apparatus 200 according to an embodiment of the present disclosure, the voice signal provided from the outside is received in step S100. That is, the sound quality improving apparatus 200 according to an embodiment of the present disclosure receives the voice signal provided from the outside, that is, the signal transmitting/receiving apparatus 100.

Further, in the operation method of the sound quality improving apparatus 200 according to an embodiment of the present disclosure, it can be determined whether the current frame of the voice signal is a Speech-like Frame (SF) or a Noise-like Frame (NF) based on sound quality improvement performance degree information on a previous frame of the pre-performed voice signal in step S110.

As a result of the determination in step S110, when it is determined that the current frame is the speech-like frame, it is preferable that the next operation is performed in accordance with the speech-like frame in the operation method of the sound quality improving apparatus 200 according to an embodiment of the present disclosure.

That is, in the operation method of the sound quality improving apparatus 200 according to an embodiment of the present disclosure, the frequency band is split into a plurality of frequency subbands according to a particular frequency response characteristic set to the system and the subtraction weight is set for each of the plurality of split frequency subbands in step S120.

In other words, in the operation method of the sound quality improving apparatus 200 according to an embodiment of the present disclosure, the particular frequency response characteristic set to the system, that is, the sending frequency response characteristic set to the frequency response filter apparatus 300 included in the system is detected and the entire frequency band is split into a plurality of frequency subbands in accordance with the detected sending frequency response characteristic.

Further, in the operation method of the sound quality improving apparatus 200 according to one or more embodiments of the present disclosure, the subtraction weight is differentially set for each of the plurality of split frequency subbands according to a predefined weight setting policy.

For example, in the operation method of the sound quality improving apparatus 200 according to one or more embodiments of the present disclosure, the subtraction weight $k_{SF}$ corresponding to the speech-like frame may be set for each frequency subband according to the weight setting policy in setting the subtraction weight different for each of the plurality of split frequency subband.

Further, in the operation method of the sound quality improving apparatus 200 according to an embodiment of the present disclosure, the gain function for each frequency band according to the particular frequency response characteristic is calculated based on the subtraction weight for each set frequency subband in step S130.

More specifically, in the operation method of the sound quality improving apparatus 200 according to an embodiment of the present disclosure, it is determined whether a noise quantity of the voice signal corresponding to each node exceeds a preset noise threshold in the current frame of the voice signal based on a plurality of nodes split from the frequency band according to a preset node split policy, and the corresponding subtraction weight among the subtraction weights set for respective frequency subbands is selected and allocated in accordance with the corresponding node which is determined to exceed the noise threshold.

That is, in the operation method of the sound quality improving apparatus 200 according to an embodiment of the present disclosure, the entire frequency band is split into a plurality of nodes according to the preset node split policy.

Further, in the operation method of the sound quality improving apparatus 200 according to an embodiment of the present disclosure, a noise threshold $SF_{TH}$ corresponding to a preset speech-like frame is recognized and it is determined whether a noise quantity $U_{m8nr,i}(j)$ of the voice signal corresponding to each node exceeds the noise threshold $SF_{TH}$ corresponding to the speech-like frame in the current frame of the voice signal according to the noise threshold $SF_{TH}$ based on the plurality of split nodes.

In the operation method of the sound quality improving apparatus 200 according to an embodiment of the present disclosure, the corresponding subtraction weight $k_{SF}$ among the subtraction weights set for respective frequency subbands may be selected and allocated in accordance with the corresponding node which is determined to exceed the noise threshold as a result of the determination whether the noise quantity of the voice signal exceeds the noise threshold.

For example, in the operation method of the sound quality improving apparatus 200 according to an embodiment of the present disclosure, when the corresponding node is included in a first frequency subband area (for example, $j<SFR_{SB}(0)$) in accordance with the corresponding node which is determined to exceed the noise threshold $SF_{TH}$, the subtraction weight corresponding to the first frequency subband can be allocated in accordance with the voice signal of the corresponding node.

In the operation method of the sound quality improving apparatus 200 according to an embodiment of the present disclosure, when the corresponding node is included in the first frequency subband area (for example, $j<SFR_{SB}(0)$), the subtraction weight $k_{SF}(0)$ corresponding to the first frequency subband, that is, frequency subband(I(0)) can be allocated in accordance with the voice signal of the corresponding node. Here, the case where the subtraction weight $k_{SF}(0)$ is allocated is determined to correspond to a weak band according to the sending frequency response characteristic, so that it may be analyzed to assign the relatively lower noise weight.

Further, in the operation method of the sound quality improving apparatus 200 according to an embodiment of the present disclosure, when the corresponding node is not included in the first frequency subband area but is included in a second frequency subband area (for example, $j<SFR_{SB}(1)$) in accordance with the corresponding node which is determined to exceed the noise threshold $SF_{TH}$, the subtraction weight $k_{SF}(I)$ corresponding to the corresponding frequency subband(I) can be allocated in accordance with the voice signal of the corresponding node.

Further, in the operation method of the sound quality improving apparatus 200 according to an embodiment of the present disclosure, when the corresponding node is not included in both the first and second frequency subband areas (for example, $j\geq SFR_{SB}(1)$) in accordance with the corresponding node which is determined to exceed the noise threshold $SF_{TH}$, a particular maximum subtraction weight $k_{SF}(L)$ can be allocated in accordance with the voice signal of the corresponding node. Here, the case where the subtraction weight $k_{SF}(L)$ is allocated is determined to correspond to an enhanced band according to the sending frequency response characteristic, so that it may be analyzed to assign the relatively higher noise weight.

As described above, in the operation method of the sound quality improving apparatus 200 according to an embodiment of the present disclosure, after the corresponding subtraction weight among subtraction weights set for respective frequency subbands in accordance with the corresponding node which is determined to exceed the noise threshold is selected and allocated, the gain function based on at least one of the subtraction weights allocated in accordance with the voice signal of the corresponding node and the noise quantity of the voice signal of the corresponding node can be calculated.

That is, in the operation method of the sound quality improving apparatus 200 according to an embodiment of the present disclosure, the following gain function can be calculated.

$$G_i^{SFR}(k)=1-(1+k_{SF})U_{m8nr,i}(j)$$

Meanwhile, in the operation method of the sound quality improving apparatus 200 according to an embodiment of the present disclosure, as a result of determination whether the noise quantity $U_{m8nr,i}(j)$ of the voice signal corresponding to each node exceeds the noise threshold $SF_{TH}$ corresponding to the speech-like frame in the current frame of the voice signal based on the noise threshold $SF_{TH}$, the gain function of the voice signal of the corresponding node can be calculated in accordance with the voice signal of the corresponding node of which noise quantity is determined to be equal to or smaller than the noise threshold $SF_{TH}$.

That is, in the operation method of the sound quality improving apparatus 200 according to an embodiment of the present disclosure, the following gain function can be calculated in accordance with the voice signal of the corresponding node of which noise quantity $U_{m8nr,i}(j)$ is determined to be equal to or smaller than the noise threshold $SF_{TH}$.

$$G_i^{SFR}(k)=1-U_{m8nr,i}(j)$$

Meanwhile, as a result of the determination of step S110, when it is determined that the current frame is the noise-like frame, it is preferable that the next operation is performed in accordance with the noise-like frame in the operation method of the sound quality improving apparatus 200 according to an embodiment of the present disclosure.

That is, in the operation method of the sound quality improving apparatus 200 according to an embodiment of the present disclosure, the frequency band is split into a plurality of frequency subbands according to the particular frequency response characteristic set to the system, and the subtraction weight is set for each of the plurality of split frequency subbands in step S150.

In other words, in the operation method of the sound quality improving apparatus 200 according to an embodiment of the present disclosure, the particular frequency response characteristic set to the system, that is, the sending frequency response characteristic set to the frequency response filter apparatus 300 included in the system, may be detected, and the entire frequency band may be split into a plurality of frequency subbands in accordance with the detected sending frequency response characteristic.

More specifically, in the operation method of the sound quality improving apparatus 200 according to an embodiment of the present disclosure, subtraction weight differentially set according to each of the plurality of split frequency subbands is set according to a predefined weight setting policy.

For example, in the operation method of the sound quality improving apparatus 200 according to an embodiment of the present disclosure, the subtraction weight $k_{NF}$ corresponding to the noise-like frame may be set for each frequency subband according to the weight setting policy in setting the subtraction weight different according to each of the plurality of split frequency subbands.

Further, in the operation method of the sound quality improving apparatus 200 according to an embodiment of the present disclosure, the gain function for each frequency band according to the particular frequency response characteristic is calculated based on the set subtraction weight for each frequency subband in step S160.

More specifically, in the operation method of the sound quality improving apparatus 200 according to an embodiment of the present disclosure, it is determined whether a noise quantity of the voice signal corresponding to each node exceeds a preset noise threshold in the current frame of the voice signal based on a plurality of nodes split from the frequency band according to a preset node split policy, and the corresponding subtraction weight among the subtraction weights set for respective frequency subbands is selected and allocated in accordance with the corresponding node which is determined to exceed the noise threshold.

That is, in the operation method of the sound quality improving apparatus 200 according to an embodiment of the present disclosure, the entire frequency band is split into a plurality of nodes according to the preset node split policy.

Further, in the operation method of the sound quality improving apparatus 200 according to an embodiment of the present disclosure, a noise threshold $NF_{TH}$ corresponding to a preset noise-like frame is recognized and it is determined whether a noise quantity $U_{m8nr,i}(j)$ of the voice signal corresponding to each node exceeds the noise threshold $NF_{TH}$ corresponding to the noise-like frame in the current frame of the voice signal according to the noise threshold $NF_{TH}$ based on the plurality of split nodes.

In the operation method of the sound quality improving apparatus 200 according to an embodiment of the present disclosure, the corresponding subtraction $k_{NF}$ among the subtraction weights set for respective frequency subbands can be selected and allocated in accordance with the corresponding node which is determined to exceed the noise threshold as a result of the determination of whether or not the noise quantity of the voice signal exceeds the noise threshold.

For example, in the operation method of the sound quality improving apparatus 200 according to an embodiment of the present disclosure, when the corresponding node is included in a first frequency subband area (for example, $j<SFR_{SB}(0)$) in accordance with the corresponding node which is determined to exceed the noise threshold $NF_{TH}$, the subtraction weight corresponding to the first frequency subband can be allocated in accordance with the voice signal of the corresponding node.

In the operation method of the sound quality improving apparatus 200 according to an embodiment of the present disclosure, when the corresponding node is included in the first frequency subband area (for example, $j<SFR_{SB}(0)$), the subtraction weight $k_{NF}(0)$ corresponding to the first frequency subband, that is, frequency subband(I(0)), can be allocated in accordance with the voice signal of the corresponding node. Here, the case where the subtraction weight $k_{NF}(0)$ is allocated is determined to correspond to a weak band according to the sending frequency response characteristic, so that it may be analyzed to assign the relatively lower noise weight.

Further, in the operation method of the sound quality improving apparatus 200 according to an embodiment of the present disclosure, when the corresponding node is not included in the first frequency subband area but is included in a second frequency subband area (for example, $j<SFR_{SB}(1)$) in accordance with the corresponding node which is determined to exceed the noise threshold $NF_{TH}$, the subtraction weight $k_{NF}(I)$ corresponding to the corresponding frequency subband(I) can be allocated in accordance with the voice signal of the corresponding node.

Further, in the operation method of the sound quality improving apparatus 200 according to an embodiment of the present disclosure, when the corresponding node is not included in both the first and second frequency subband areas (for example, $j\geq SFR_{SB}(1)$) in accordance with the corresponding node which is determined to exceed the noise threshold $NF_{TH}$, a particular maximum subtraction weight $k_{NF}(L)$ can be allocated in accordance with the voice signal of the corresponding node. Here, the case where the subtraction weight $k_{NF}(L)$ is allocated is determined to correspond to an enhanced band according to the sending frequency response characteristic, so that it may be analyzed to assign the relatively higher noise weight.

As described above, in the operation method of the sound quality improving apparatus 200 according to an embodiment of the present disclosure, after the corresponding subtraction weight among subtraction weights set for respective frequency subbands in accordance with the corresponding node which is determined to exceed the noise threshold is selected and allocated, the gain function based on at least one of the subtraction weights allocated in accordance with the voice signal of the corresponding node and the noise quantity of the voice signal of the corresponding node can be calculated.

That is, in the operation method of the sound quality improving apparatus 200 according to an embodiment of the present disclosure, the following gain function can be calculated.

$$G_i^{SFR}(k)=1-(1+k_{SF})U_{m8nr,i}(j)$$

Meanwhile, in the operation method of the sound quality improving apparatus 200 according to an embodiment of the present disclosure, as a result of determination whether the noise quantity $U_{m8nr,i}(j)$ of the voice signal corresponding to each node exceeds the noise threshold $NF_{TH}$ corresponding to the noise-like frame in the current frame of the voice signal based on the noise threshold $NF_{TH}$, the gain function of the voice signal of the corresponding node can be calculated in accordance with the voice signal of the corresponding node of which noise quantity is determined to be equal to or smaller than the noise threshold $NF_{TH}$.

That is, in the operation method of the sound quality improving apparatus 200 according to an embodiment of the present disclosure, the following gain function can be calculated in accordance with the voice signal of the corresponding node of which noise quantity $U_{m8nr,i}(j)$ is determined to be equal to or smaller than the noise threshold $NF_{TH}$.

$$G_i^{SFR}(k)=1-U_{m8nr,i}(j)$$

Further, in the operation method of the sound quality improving apparatus 200 according to an embodiment of the present disclosure, sound quality of the voice signal is improved by reflecting the gain function calculated in step S130 or S160 in step S140.

Specifically, in the operation method of the sound quality improving apparatus 200 according to an embodiment of the present disclosure, sound quality of the voice signal of which the corresponding gain function exceeds a smoothing coefficient β is improved with reflection of the corresponding gain function based on the gain function for each frequency band according to the particular frequency response characteristic calculated in step S130 or S160, and sound quality of the voice signal of which the corresponding gain function does not exceed the smoothing coefficient β is improved with reflection of the spectral smoothing coefficient β.

In other words, in the operation method of the sound quality improving apparatus 200 according to an embodiment of the present disclosure, the sound quality of the voice signal can be improved by reflecting the gain function calculated in step S130 or S160 through equation (1).

Further, in the operation method of the sound quality improving apparatus 200 according to an embodiment of the present disclosure, it is preferable that sound quality improvement performance degree information according to the sound quality improvement performed for the current frame of the voice signal is stored/managed and then referred to in step S110.

In the operation method of the sound quality improving apparatus 200 according to an embodiment of the present disclosure, by allocating a relatively high noise weight to the enhanced band and a relatively low noise weight to the weak band by considering the sending frequency response characteristic of the frequency response filter apparatus 300, the sound quality of the voice signal can be improved through a modified spectral subtraction method based on the gain function reflecting the allocation.

Further, in the operation method of the sound quality improving apparatus 200 according to an embodiment of the present disclosure, the voice signal according to the sound quality improvement performance, that is, the improved voice signal is provided to the frequency response filter apparatus 300.

As described above, the method of improving sound quality of voice signal according to the at least one embodiment can suppress the residual musical noise in the enhanced band which may be caused by the SFR characteristic and guarantee speech intelligibility in the weak band by improving the sound quality of the voice signal through the modified spectral subtraction method based on gain functions differentially set considering the sending frequency response characteristic.

The various embodiments as described above may be implemented in the form of one or more program commands that can be read and executed by a variety of computer systems and be recorded in any non-transitory, a computer-readable recording medium. The computer-readable recording medium may include a program command, a data file, a data structure, etc. alone or in combination. The program commands written to the medium are designed or configured especially for the at least one embodiment, or known to those skilled in computer software. Examples of the computer-readable recording medium include magnetic media such as a hard disk, a floppy disk, and a magnetic tape, optical media such as a CD-ROM and a DVD, magneto-optical media such as an optical disk, and a hardware device configured especially to store and execute a program, such as a ROM, a RAM, and a flash memory. Examples of a program command include a premium language code executable by a computer using an interpreter as well as a machine language code made by a compiler. The hardware device may be configured to operate as one or more software modules to implement one or more embodiments of the present disclosure. In some embodiments, one or more of the processes or functionality described herein is/are performed by specifically configured hardware (e.g., by one or more application specific integrated circuits or ASIC(s)). Some embodiments incorporate more than one of the described processes in a single ASIC. In some embodiments, one or more of the processes or functionality described herein is/are performed by at least one processor which is programmed for performing such processes or functionality.

While the present disclosure has been shown and described with reference to certain embodiments thereof, it will be understood by those skilled in the art that various changes in form and details may be made therein without departing from the subject matter, the spirit and scope of the present disclosure as defined by the appended claims. Specific terms used in this disclosure and drawings are used for illustrative purposes and not to be considered as limitations of the present disclosure.

What is claimed is:

1. A system for improving sound quality of a voice signal in voice communication, the system comprising:

a sound quality improving apparatus comprising one or more processors configured to set a subtraction weight for each of a plurality of frequency subbands split based on a particular frequency response characteristic set to the system, calculate a gain function for each frequency band according to the particular frequency response characteristic based on the subtraction weight for each of the frequency subbands, and improve sound quality of a voice signal by reflecting the calculated gain function;

a frequency response filter configured to filter the voice signal provided from the sound quality improving apparatus according to the preset frequency response characteristic; and an output apparatus configured to output the filtered voice signal.

2. The system of claim 1, wherein the sound quality improving apparatus comprises a signal receiver configured to receive the voice signal;

a subband splitter configured to split a frequency band into the plurality of frequency subbands according to the particular frequency response characteristic;

a gain function calculator configured to set the subtraction weight for each of the plurality of split frequency subbands and to calculate a gain function for each of the frequency bands based on the subtraction weight for each of the frequency subbands; and a sound quality improving unit configured to improve sound quality of the voice signal by reflecting the calculated gain function.

3. The system of claim 2, wherein the gain function calculator is configured to set different subtraction weights for different frequency subbands split based on the particular frequency response characteristic according to a predefined weight setting policy.

4. The system of claim 3, wherein the gain function calculator is configured to determine whether a noise quantity of the voice signal corresponding to each node in a current frame of the voice signal exceeds a preset noise threshold based on a plurality of nodes split from the frequency band according to a preset node splitting policy, select a corresponding subtraction weight from the subtraction weights set for each of the frequency subbands in accordance with a corresponding node which is determined to have the noise quantity exceeding the noise threshold, and allocate the selected subtraction weight to each of the frequency subbands.

5. The system of claim 4, wherein the gain function calculator is configured to calculate the gain function in accordance with the voice signal of the corresponding node, when the corresponding node is determined to have the noise quantity equal to or smaller than the noise threshold.

6. The system of claim 4, wherein, in accordance with the corresponding node which is determined to have the noise quantity exceeding the noise threshold, when the corresponding node is included in a first frequency subband area, the gain function calculator is configured to allocate a subtraction weight corresponding to the first frequency subband in accordance with the voice signal of the corresponding node, when the corresponding node is included in a second frequency subband area, the gain function calculator is configured to allocate a subtraction weight corresponding to the second frequency subband in accordance with the voice signal of the corresponding node, and when the corresponding node is not included in both the first and the second frequency subband areas, the gain function calculator is configured to allocate a particular maximum subtraction weight in accordance with the voice signal of the corresponding node.

7. The system of claim 4, wherein the gain function calculator is configured to calculate the gain function based on at least one of the allocated subtraction weight and the noise quantity of the voice signal of the corresponding node, when the corresponding node is determined to have the noise quantity exceeding the noise threshold.

8. The system of claim 2, wherein the sound quality improving unit is configured to, based on the gain function for each of the frequency bands according to the particular frequency response characteristic calculated by the gain function calculator, improve sound quality by reflecting the gain function for the voice signal, when the gain function exceeds a predefined spectral smoothing coefficient β, and improve sound quality by reflecting the spectral smoothing coefficient β for the voice signal, when the gain function does not exceed the predefined spectral smoothing coefficient β.

9. The system of claim 2, further comprising a frame determiner configured to determine whether the current frame of the voice signal is a speech-like frame or a noise-like frame based on sound quality improvement performance degree information on a previous frame of the voice signal performed by the sound quality improving unit.

10. The system of claim 9, wherein, based on a result of the determination by the frame determiner, when the current frame of the voice signal is the speech-like frame, the gain function calculator is configured to differentially set the subtraction weight for each of frequency subbands in accordance with the speech-like frame and the noise threshold preset in accordance with the speech-like frame, and when the current frame of the voice signal is the noise-like frame, the gain function calculator is configured to differentially set the subtraction weight for each of frequency subbands in accordance with the noise-like frame and the noise threshold preset in accordance with the noise-like frame.

11. A method of improving sound quality of a voice signal in voice communication, the method performed by a system comprising one or more processors, and the method comprising:

receiving a voice signal;

splitting a frequency band into a plurality of frequency subbands according to a particular frequency response characteristic;

setting a subtraction weight for each of the plurality of split frequency subbands;

calculating a gain function for each of the frequency bands based on the set subtraction weight for each of the frequency subbands;

filtering the voice signal improved by using the calculated gain function according to the preset frequency response characteristic; and outputting the filtered voice signal.

12. The method of claim 11, further comprising determining whether the current frame of the voice signal is a speech-like frame or a noise-like frame based on sound quality improvement performance degree information on a previous frame of the voice signal for which sound quality has been improved.

13. The method as claimed in claim 12, wherein the calculating of the gain function comprises setting the subtraction weight for each of frequency subbands according to the weight setting policy in accordance with the speech-like frame and the noise threshold preset in accordance with the speech-like frame when the current frame of the voice signal is determined as the speech-like frame, and setting the subtraction weight for each of frequency subbands according to the weight setting policy in accordance with the noise-like frame and the noise threshold preset in accordance with the noise-like frame when the current frame of the voice signal is determined as the noise-like frame.

14. The method of claim 11, wherein the calculating of the gain function comprises setting different subtraction weights for different frequency subbands split based on the particular frequency response characteristic according to a predefined weight setting policy.

15. The method of claim 11, wherein the calculating of the gain function comprises determining whether a noise quantity of the voice signal corresponding to each node in a current frame of the voice signal exceeds a preset noise threshold based on a plurality of nodes split from the frequency band, selecting a corresponding subtraction weight from the subtraction weights set for each of the frequency subbands in accordance with a corresponding node which is determined to have the noise quantity exceeding the noise threshold, and allocating the selected subtraction weight to each of the frequency subbands.

16. The method of claim 15, wherein, in accordance with the corresponding node which is determined to have the noise quantity exceeding the noise threshold, the calculating of the gain function comprises allocating a subtraction weight corresponding to a first frequency subband in accordance with the voice signal of the corresponding node when the corresponding node is included in the first frequency subband area, allocating a subtraction weight corresponding to the second frequency subband in accordance with the voice signal of the corresponding node when the corresponding node is included in a second frequency subband area, and allocating a particular maximum subtraction weight in accordance with the voice signal of the corresponding node when the corresponding node is not included in both the first and the second frequency subband areas.

17. The method as claimed in claim 11, wherein the calculating of the gain function comprises calculating the gain function based on at least one of the allocated subtraction weight and the noise quantity of the voice signal of the corresponding node, when the corresponding node is determined to have the noise quantity exceeding the noise threshold.

18. The method as claimed in claim 11, wherein the calculating of the gain function comprises calculating the gain function in accordance with the voice signal of the corresponding node, when the corresponding node is determined to have the noise quantity equal to or smaller than the noise threshold.

* * * * *